United States Patent [19]

Gill

[11] Patent Number: 4,554,740

[45] Date of Patent: Nov. 26, 1985

[54] PANTOGRAPHS

[76] Inventor: David Gill, 3200 25th St., Columbus, Ind. 47203

[21] Appl. No.: 583,748

[22] Filed: Feb. 27, 1984

[51] Int. Cl.[4] ..... B43L 13/10

[52] U.S. Cl. ..... 33/25 R; 33/23 B

[58] Field of Search ..... 33/1 K, 20 R, 23 R, 33/23 D, 23 H, 25 R, 25 E, 25 D

[56] References Cited

U.S. PATENT DOCUMENTS 1,684,887 9/1928 Ridgway ..... 33/23 B 4,397,090 8/1983 Nictper ..... 33/25 R

*Primary Examiner*—Robert I. Smith

*Attorney, Agent, or Firm*—Gary M. Gron

[57] ABSTRACT

The disclosure illustrates a pantograph comprising a pair of parallel guides slideably and pivotally mounted on a base support which is mounted to a table. A saddle supporting a stylus is mounted on one end of the guides and another saddle slideable on the guides mounts a tool such as a router. A series of parallel adjustable links interconnect the base, tool mounting saddle and stylus saddle, so that movement of the tool saddle is a predetermined scale of the stylus movement. The scale is set by the geometry of the links. The pantograph may also be used to make three dimensional reproductions of an object.

15 Claims, 8 Drawing Figures

PANTOGRAPHS

The present invention trelates to pantographs and more specifically to improvements in such devices.

The pantograph has been used for many years as a device for causing the two dimensional movement of a stylus to be reproduced in a predetermined scale by a follower or work holder. The pantograph, in simple terms, consists of a set of parallel linkages having one joint pivotally mounted on a base and a stylus mounted on one of the links not pivotally connected to the base. A follower is mounted on one of the other links and the geometry between the links and elements determines the degree to which the motion of the stylus is scaled. An example of a traditional pantograph may be found in the patent to Rollandet No. 852,036. Another example may be found in the patent to Dinnendahl No. 3,496,795. In a traditional pantograph machine, the control and support mechanism are combined with the result that wear of the pivotal joints, through prolonged use, causes play and attendant inaccuracies in the manner in which it reproduces movement. Such problems are recognized and addressed in Dinnendahl who provides a novel type of low friction precision joint. However, Dinnendahl still maintains a combined control/-support mechanism.

Separation of the control and support function was first shown in Ridgway U.S. Pat. No. 1,684,887, which shows parallel rails pivotally supported by a central base and a pair of carriage elements positioned on either side of the base for relative sliding movement. Sets of pulleys with unequal diameters cause movement of the first carriage to be a predetermined ratio relative to the other. Although this system separates the control and support function, it brings with it additional problems associated with stretch of the cable and wear of the pulley pivot. Furthermore, adjustment of the ratios is extremely complicated and cumbersome since pulleys and cables of different dimensions must be substituted. This type of arrangement has the additional problem that the carriages are on opposite sides of the central base thus causing the resultant motion to be a flip-flop of the reproduced motion.

In accordance with the present invention, the above problems are solved by a linkage apparatus which comprises a base for pivotally supporting at least one elongated support guide, at least about a first axis perpendicular to a reference plane. First and second elements are supported by the support guide on one side of the base for linear displacement along the longitudinal axis of the support guide means, relative to the first axis. An interconnecting assembly interconnects the base and the first and second elements so that the two dimensional displacement of the elements are a given ratio relative to one another in said reference plane.

The above and other related features of the present invention will be apparent from reading of the following description, of the disclosure pointed out in the drawing and the novelty thereof pointed out in the appended claims.

In the drawings.

Figure 1:
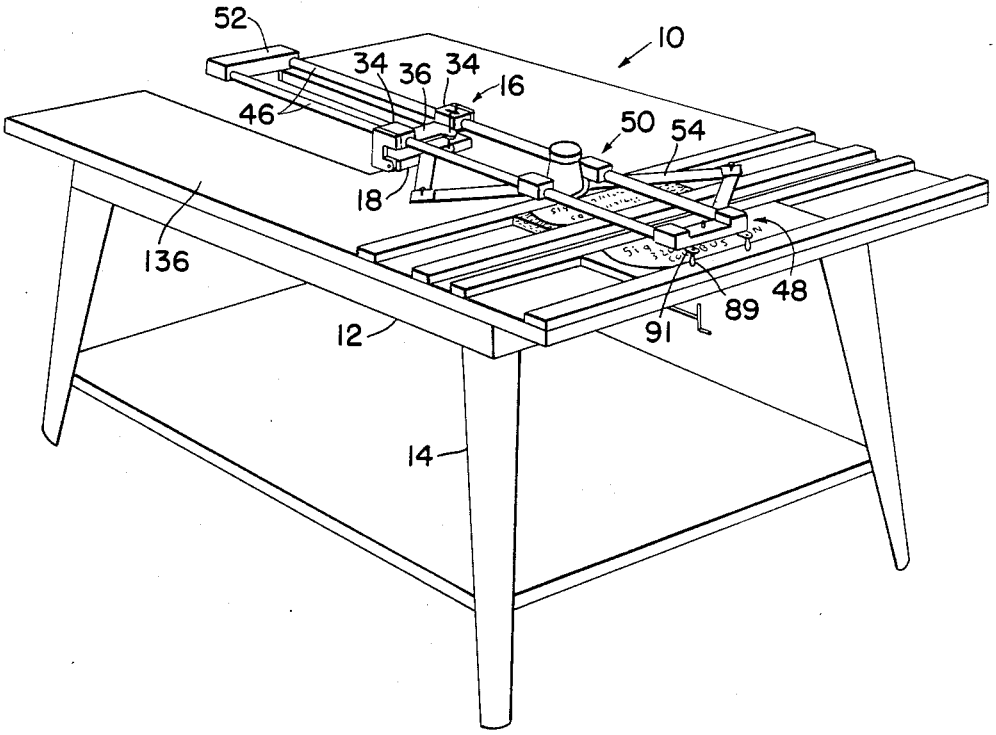
FIG. 1 is a perspective view of a pantograph embodying the present invention.
Figure 2:
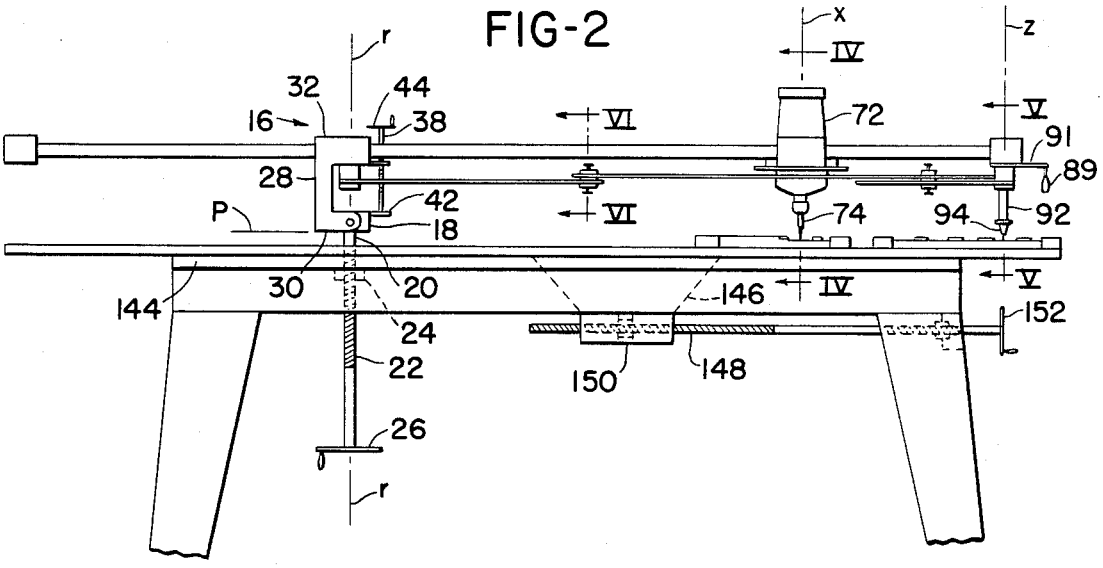
FIG. 2 is a side elevational view of the pantograph of FIG. 1.
Figure 3:
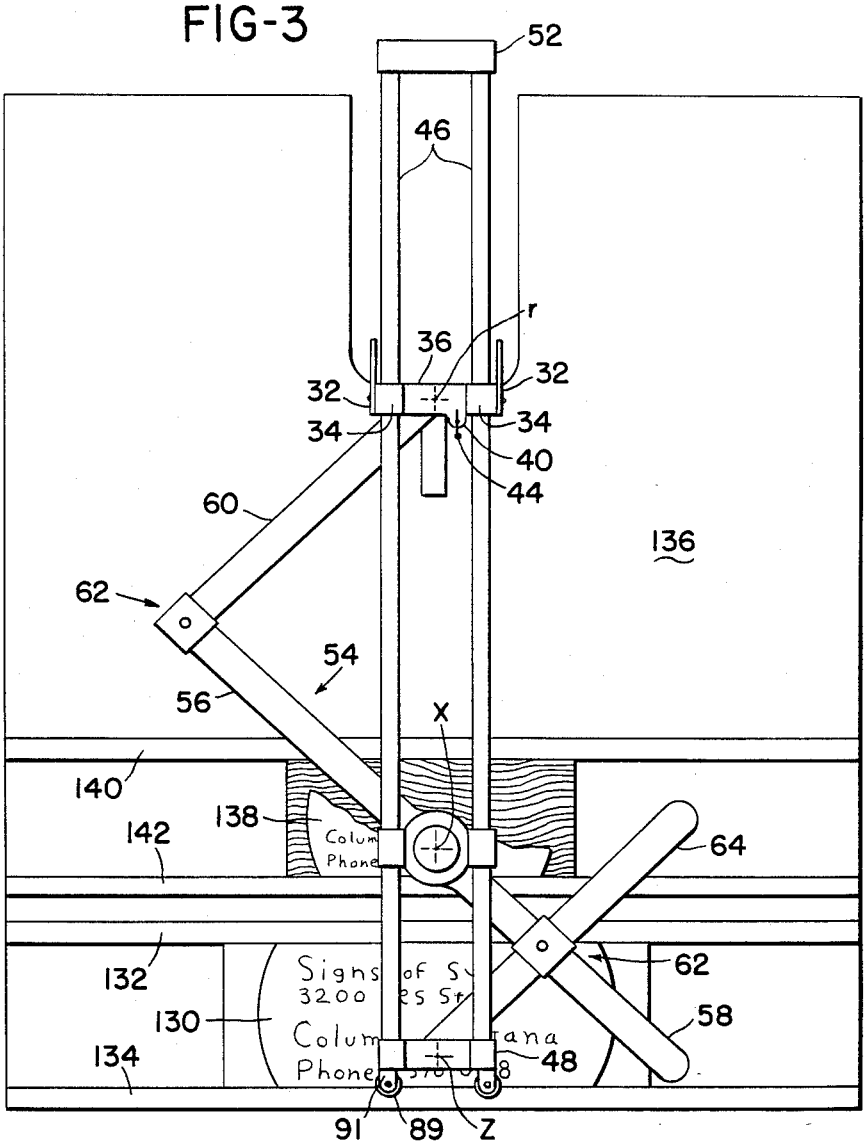
FIG. 3 is a plan view of the pantograph of FIG. 1.

Referring to FIGS. 1–3, there is shown a pantograph 10 comprising a rectangular base frame 12 having support legs 14. A base assembly 16 comprises a plate 18 journaled over shaft 20 for pivoting movement. Shaft 20 has a threaded portion 22 received in nut 24 appropriately fixed to frame 12 so that rotation of shaft 20 through handle 26 will raise or lower plate 18 and thus base assembly 16. A pair of generally C shaped side plates 28 have first legs 30 pivotally connected to plate 18 and second legs 32 supporting bearing blocks 34. Bearing blocks 34 are interconnected by an upper plate 36 having a threaded shaft 38 engaging a tab 40 and extending to a stop tab 42 on plate 18. A handle 44 on shaft 38 enables the position of upper plate 36 to be pivotally adjusted relative to plate 18.

Bearing blocks 34 slideably receive elongated support guides 46 that have at one end thereof an interconnecting stylus support saddle 48 and an intermediate tool support saddle 50. The saddles 48, 50 and base assembly 16 are interconnected with support guides 46 in such a manner that permits movement of saddles 48 and 50 relative to one another and to base assembly 16. The illustrated embodiment features the saddle 48 fixed to guides 46 and saddle 50 and base assembly 16 slideable along guides 46 with a bracing saddle 52 fixed to the opposite end of guides 46. It should be noted however that an alternate arrangement may be employed to achieve the same resulting movement. For example, guides 46 could be fixed either to saddle 50 or base assembly 16 and the remaining elements permitted to slide along guides 46.

As shown particularly in FIG. 3, a pivoting linkage interconnects base assembly 16 and saddles 48, 50. The linkage comprises a first link 54 pivotally mounted to tool saddle 50 about an axis x and having first and second arms 56, 58 respectively. A second link 60 is pivotally connected to the base assembly 16 about an axis r that is parallel to axis x. Link 60 is also pivotally connected to arm 56 by adjustable clamp assembly 62 to be described in detail later. A third link 64 is pivotally connected to saddle 48 at an axis z that is parallel to axis x and y. The other end of link 64 is pivotally connected to arm 58 of link 54 by means of another adjustable clamp assembly 62. As shown particularly in FIG. 2, the three axes x, r, and z are all perpendicular to a reference plane P.

The details of the bearing assemblies that permit relative sliding movement of the saddle and base have been omitted to facilitate the understanding of the present invention. It should be apparent to those skilled in the art that suitable bearings or bearing material may be employed for this purpose. For example, sleeves of self-lubricating material may be used, but if accurate movement is desired roller bushing bearings, Part No. A 162536, manufactured by Thompson Industries, Inc., Manhasset, N.Y., may be used with acceptable results. It should also be noted that, while the guides 46 are shown as circular in cross section, they may assume other shapes such as square with appropriate bearing configurations.

Figure 4:
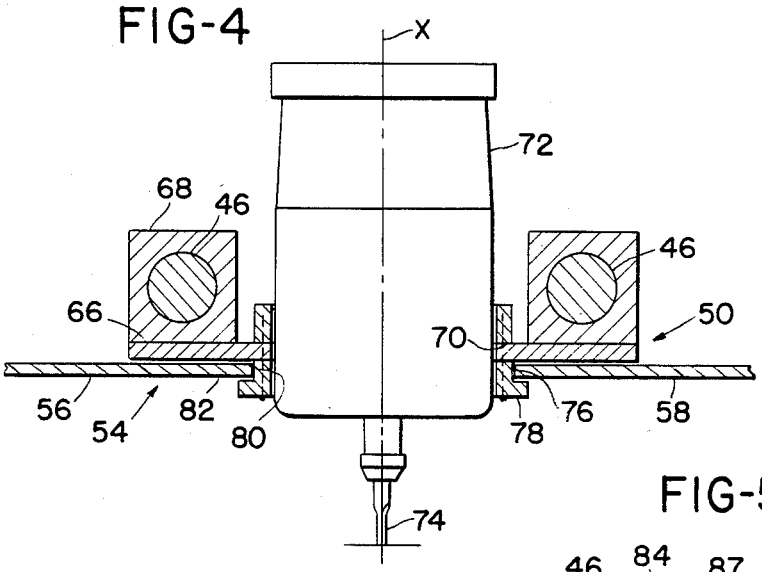
FIG. 4 is an enlarged fragmentary cross section view taken on lines IV—IV of FIG. 2.

Turning now to FIG. 4, there are shown details of the pivotal mounting of the link 54 to saddle 50. Saddle 50 includes a plate 66 that interconnects bearing blocks 68 through which guides 46 extend. Plate 66 has a central generally circular opening 70 about axis x for receiving a tool 72, herein shown as a router having a cutting bit 74 for cutting away desired material. Other tools may be employed in this location for example, any type of material removing tool or imprinting tool. An appropriate clamp (not shown) enables tool 72 to be easily installed or removed from saddle 50. A cylindrical projection 76, connected to plate 66, has an integral flange 78, which captures link 54 and permits pivoting movement by means of a circular bore 80 formed in an expanded center section 82 of link 54.

Figure 5:
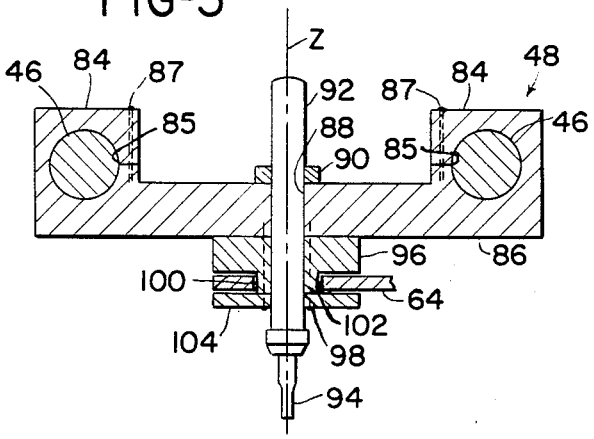
FIG. 5 is an enlarged fragmentary cross section view taken on lines V—V of FIG. 2.

As shown in FIG. 5, saddle 48 is clamped to guides 46 through integral clamping blocks 84 split at 85 by tightening screws 87. An integral plate section 86 has a bore 88 with axis z. An adjustable clamping device 90 enables a stylus 92 with follower tip 94 to be easily installed or removed. A bottom cylindrical post 96 is secured to plate 86 by screws 98 and has a cylindrical pilot 100 to pivotally mount link 64 by means of a circular bore 102. A plate 104 captures link 64. As shown particularly in FIGS. 1–3, saddle 48 has a pair of downward facing handles 89 mounted on projections 91.

Figure 6:
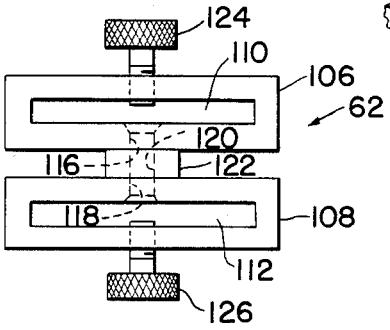
FIG. 6 is an enlarged cross section view taken on lines VI—VI of FIG. 2, showing an adjustable clamp.
Figure 7:
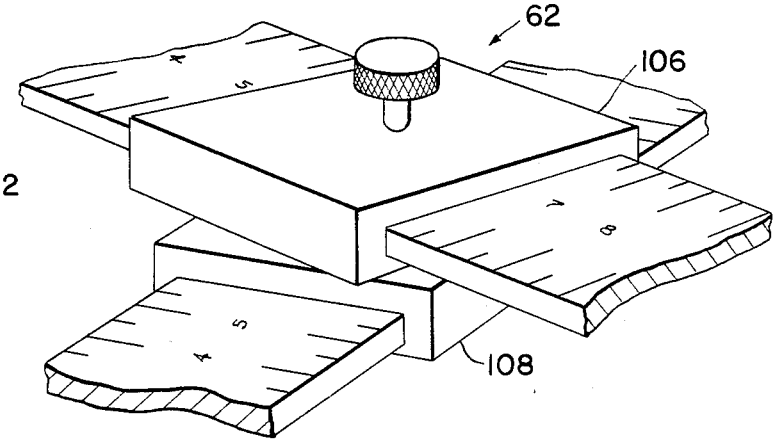
FIG. 7 is a perspective view of the adjustable clamp of FIG. 6.

The adjustable clamp assembly 62, shown in FIGS. 6 and 7 comprises first and second clip blocks 106, 108 each having through slots 110, 112, respectively, that receive one of the links. The clip blocks 106, 108 are pivotally interconnected by a flanged pin 114 extending through boxes 116, 118 in block 106, 108 respectively and a bore 120 in a separating block 122. Set screws 124, 126 are threaded through clip blocks 106, 108 to adjustibly clamp an appropriate link.

Returning to FIGS. 1 and 3, the stylus 92 is adapted to traverse an array of guide letters 130, clamped between elongated clamp elements 132, 134 connected to platform 136. The tool 72 is adapted to traverse a block of material 138 and remove material to achieve the guide letters, but on a preselected scale. The material 138 is also clamped to platform 136 by additional clamping elements 140, 142.

Platform 136 is moveable relative to the base frame 12 along guide rails 144. A web 146 connects to platform 136 and extends downward for threaded engagement with a threaded shaft 148. Shaft 148 has a flange 150 captured in base 12 so that rotation of shaft 148 through crank arm 152 will displace platform 136 relative to base frame 12.

The operation of the pantograph will now be discussed with particular reference to FIGS. 1–3. In FIG. 3 there is shown an array of guide letters 130 and a block of material 138 from which material will be removed to reproduce the letters but on a reduced scale. The adjustable clamp assemblies 62 are used to vary the relative lengths of the links and thus the scale of reduction. It should be noted that whatever lengths are chosen, links 60 and 64 must be parallel to one another to provide true reproduction, although they may be varied to provide a bias to the reproduced form. In FIG. 3, the effective length of link 60 and arm 56 are longer than the effective length of link 64 and arm 58, resulting in a scale of reduction of 75%. In FIG. 1, the effective lengths are all equal resulting in a scale of reduction of 50%. If the effective lengths of link 60 and arm 56 are made shorter than the effective length of link 65 and arm 58, the scale will be less than 50%. In practice, a variety of scales from about 15% to 85% may be achieved by appropriate selection of the arm lengths. In order to facilitate ready adjustment of the adjustable clamping assemblies, the various links and arms are provided with suitable scales as shown in FIG. 7.

The formula for determining the scale is:

$$\frac{L\,60 + L\,56}{L\,60 + L\,56 + L\,64 + L\,58} = \%\ \text{reduction}$$

Where L represents the effective length of the various elements as identified by the associated number and % reduction equals the reduced size divided by the original size.

Once the scale is selected the stylus tip 94 is moved around the guide letters and the corresponding movement of the router bit 74 removes material. It should be noted that the guides 46 provide a heretofore unattainable accurate, stable and effortless movement of the tool 72. The separation of the support and control function permits the linkage to be only rigid enough to provide the desired motion, not support tool 72. Furthermore, the wear on the linkage is not as great and it moves more freely since it does not have to have joints that perform a support function. The links are easily adjustable and provide great flexibility in the selection of scale.

If it is desired to change scale for only some of the guide letters, the moveable platform enables the letters to be formed without reclamping the guide letters 130 and block 138.

By placing the tool and stylus on the same side of the pivot axis r, the motion is in the same direction as that of the guide, thus enabling quick and accurate observation of the results of the work.

Figure 8:
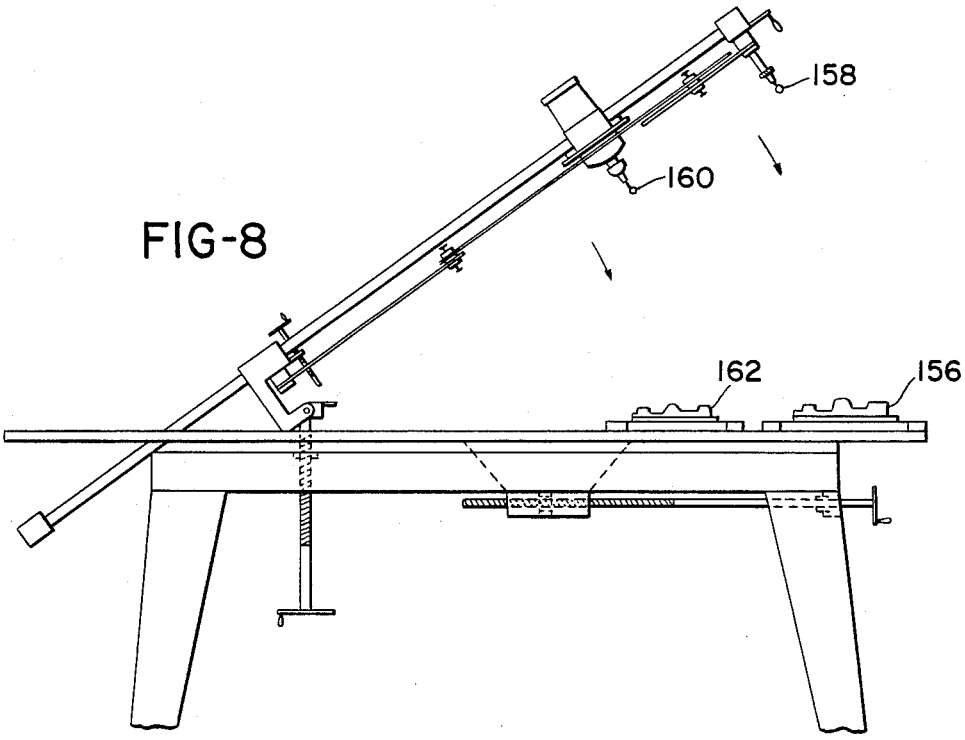
FIG. 8 is a side elevational view of the pantograph of FIG. 2 illustrating the application to a three dimensional reproduction of a shape.

A further benefit is that the pantograph may be used for three dimensional reproduction of an object, as illustrated in FIG. 8. In FIG. 8, the tool bit is spherical, as well as the stylus tip. A guide form 156 is followed by a spherical stylus tip 158 and a spherical tool bit 160 removes material from a block 162. It should be noted that the pivot for the base assembly 16 lies in the plane P which also contains the tip of the tool bit and stylus tip and tilt upward to follow the vertical displacement of the stylus tip 158. Because of this relationship, the three dimensional movement of the tool bit is a predetermined ratio or scale of the guide object, and includes the formation of flat surfaces that are parallel to the platform.

While a preferred embodiment of the present invention has been disclosed it should be apparent to those skilled in the art that it may be practiced in other forms without departing from the spirit and scope of the present invention.

Having thus described the invention, what is claimed as novel and desired to be secured by Letters Patent of the United States is:

1. A pantograph apparatus comprising:

means for defining at least one elongated support guide;

base means for at last pivotally supporting said support guide about a first axis perpendicular to a reference plane;

first and second elements supported by said support guide means on one side of said base means for linear displacement along the longitudinal axis of said support guide means relative to the first axis and for simultaneous rotational displacement in the same direction around said first axis;

means defining an interconnecting assembly for interconnecting said base means and said first and second elements to cause simultaneous linear displacements of said first and second elements in the same direction along said longitudinal axis toward and away from said first axis at a predetermined ratio whereby the two dimensional displacement of said first and second elements relative to said base means are a given ratio relative to one another in said reference plane.

2. Apparatus as in claim 1 wherein:

said first element is positioned between the base means and said second element and said interconnecting means comprises a first link pivotally mounted on said first element about an axis perpendicular to the longitudinal axis of said elongated support element and second and third links pivotally connected to the ends of said first link and pivotally mounted respectively to said base means and to said second element.

3. Apparatus as in claim 2 wherein one of said elements supports a tool means and the other supports a stylus means.

4. Apparatus as in claim 1 wherein said elongated support guide means comprises a pair of spaced, generally parallel elements, said first and second elements comprising cross members at least extending between and being supported thereby.

5. Apparatus as in claim 4 wherein said cross members have openings through which said parallel elements extend.

6. Apparatus as in claim 5 wherein said parallel elements are circular in cross section.

7. Apparatus as in claim 1 wherein said second element is fixed to said support guide means, said first element being slideable relative to said support guide means.

8. Apparatus as in claim 1 wherein:

said base means also pivotally mounts said support guide means to pivot about a second axis which is parallel to said reference plane and which intersects the first pivotal axis of said base means whereby the movement of the second and first elements, in three dimensions, have a predetermined relation to one another.

9. Apparatus as in claim 2 further comprising means for adjustably selecting the relative length of said links whereby the displacement ratios of said elements may be varied.

10. Apparatus as in claim 9 wherein said adjustment means comprises first and second clip means pivotally connected to one another, each clip being slideable over adjacent links, and means for adjustably clamping said clip means to said links thereby permitting adjustable effective lengths thereof.

11. Apparatus as in claim 3 wherein:

said elongated support guide means comprises a pair of spaced, generally parallel elements;

said first element is adapted to support a tool means and comprises a pair of bearing blocks through which said support elements extend and a plate interconnecting said bearing blocks, said plate having an opening for receiving a tool.

12. Apparatus as in claim 11 wherein:

said plate further comprises a cylindrical projection, the axis of said projection being coincident with the axis of a tool to be mounted therein;

said first link comprises an expanded outer section having a circular bore, said bore being received over said cylindrical projection and said link has first and second arms for connection with said second and third links.

13. Apparatus as in claim 4 wherein said base means comprises;

a support plate pivotally mounted to a base;

a pair of C shaped side plates each having one leg thereof pivotally mounted to said plate;

a plate interconnecting the other legs of said side plates; and, a pair of bearing blocks mounted on said interconnecting plate, said bearing blocks slideably receiving said guide means.

14. Apparatus as in claim 13 further comprising:

a stop on said support plate; and, a threaded shaft on said interconnecting plate for interacting with the stop of said base plate and thus permitting adjustment of the elevation of said guide elements.

15. Apparatus as in claim 14 further comprising:

a platform over which said linkage apparatus is supported;

adjustable clamping means on said platform for clamping objects to be reproduced; and, means for adjustably displacing said platform in a direction in line with the location of said base means for permitting adjustment of the scale of reproduction.

* * * * *